United States Patent [19]

Muscala

[11] Patent Number: 4,758,456

[45] Date of Patent: Jul. 19, 1988

[54] BOTTLE SEAL

[75] Inventor: James A. Muscala, Minnetonka, Minn.

[73] Assignee: Morgan Adhesives Company, Stow, Ohio

[21] Appl. No.: 27,175

[22] Filed: Mar. 18, 1987

[51] Int. Cl.[4] ..... B65D 51/20

[52] U.S. Cl. ..... 428/42; 215/232; 215/246; 428/43; 206/606

[58] Field of Search ..... 215/232, 246, 257; 428/43, 42; 206/606

[56] References Cited

U.S. PATENT DOCUMENTS

| | | | |
|---|---|---|---|
| 2,383,728 | 8/1945 | Little | 206/606 |
| 3,300,118 | 1/1967 | Owens | 206/606 |
| 3,873,018 | 3/1975 | Donnay | 215/246 X |
| 4,004,705 | 1/1977 | Fujio | 215/246 |
| 4,009,793 | 3/1977 | Minesinger et al. | 215/246 |
| 4,633,648 | 1/1987 | Yeung | 215/246 X |

*Primary Examiner*—Donald F. Norton

*Attorney, Agent, or Firm*—Oldham, Oldham & Weber Co.

[57] ABSTRACT

A seal for a bottle and cap assembly. The seal is formed from a heat shrink sheet which is adhesively coated on one side. A pull tab is formed by a pair of cuts in one edge of the sheet forming the seal and a tear strip is adhesively secured to the back of the sheet in registration with the pull tab. After being adhesively secured to a bottle and cap assembly, the sheet is heat shrunk to conform to the contour of the bottle and to provide a flange over the bottle cap. In one embodiment the pull tab is in registration with the area of joinder between the cap and the bottle and in another, the sheet is devoid of adhesive in an area extending from the pull tab and bridging the joinder between the cap and bottle. In either case, pulling of the pull tab separates the sheet into a first piece adhered to the cap and a second piece adhered to the bottle allowing for the only possible access to the bottle without evidence of tampering showing in the sheet.

9 Claims, 3 Drawing Sheets

BOTTLE SEAL

TECHNICAL FIELD

The invention herein resides in the art of bottle seals. More particularly, it presents a heat shrink adhesive laminate configured to adhere to a bottle to prevent entry thereto until removal of a tear strip.

BACKGROUND ART

The security of bottles containing goods for retail sales has become increasingly compelling in the past decade. Previously, the ability to make entry to bottles on store shelves at will has encouraged terrorists and extortionists to capitalize upon the fear induced into the consuming public in an effort to obtain unwarranted demands. Further, the consuming public itself has felt a certain unrest knowing that substances which they purchased may have been previously accessed by individuals without authority or rightful purpose.

Accordingly, there is a need for bottles having security coverings from which it may be readily apparent that entry has been made or attempted. In like manner, such a security covering will give assurance to a purchaser that unauthorized access has not been made. There is a further need for bottles having a seal which is easy to remove by the ultimate purchaser and authorized user. The security covering or seal for such bottles must be both inexpensive to manufacture and to implement. Further, the composite of the bottle with a security covering must be reliable in operation so as to enhance the confidence factor in its use.

DISCLOSURE OF INVENTION

In light of the foregoing, it is a first aspect of the invention to provide a bottle having a security covering from which it is apparent whether entry has previously been made or attempted.

Another aspect of the invention is the provision of a bottle having a security covering wherein the covering is easy to remove by the ultimate authorized purchaser or user.

Another aspect of the invention is the provision of a security covering for a bottle which is inexpensive to manufacture and implement.

Still a further aspect of the invention is the provision of a bottle having a security covering which is reliable in operation.

Yet another aspect of the invention is the provision of a bottle seal which is easily removed by a tear strip lying beneath the seal and encompassing the bottle.

An additional aspect of the invention is a bottle seal of unitary construction wherein a single seal covers both the body of the bottle and a cap thereof and which also serves as a label.

The foregoing and other aspects of the invention which will become apparent as the detailed description proceeds are achieved by a bottle assembly, comprising: a bottle; a cap received upon said bottle to seal an open end thereof; and a seal bridging said bottle and cap, said seal having pull tab means for separating a first portion of said seal associated with said cap from a second portion of said seal associated with said bottle.

Other aspects of the invention are attained by a seal for a bottle and cap assembly, comprising: a face sheet; an adhesive layer on a backside of said face sheet; a pull tab cut through said face sheet at an edge thereof; and a backing layer adhered to said pull tab and crossing said backside of said face sheet.

DESCRIPTION OF THE DRAWINGS

For a complete understanding of the objects, techniques and structure of the invention reference should be had to the following detailed description and accompanying drawings wherein.

BEST MODE FOR CARRYING OUT THE INVENTION

Figure 1:
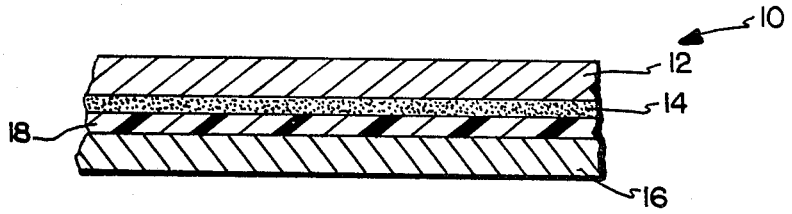
FIG. 1 is a cross sectional view of a laminate used for making the seal of the invention.

Referring now to the drawings and more particularly FIG. 1, it can be seen that an adhesive laminate according to the invention is designated generally by the numeral 10. In the preferred embodiment, the laminate 10 includes a face sheet 12 of heat shrink stock. In a typical application, the stock of the sheet 12 would be polyvinyl chloride (PVC) or other suitable material. The face sheet 12 has a thickness of 0.0005–0.0035 inch and is preferably on the order of 0.0015 inch.

Adhered to a back surface of the face sheet 12 is a suitable pressure sensitive adhesive 14. A liner 16, typically of clay coated kraft, plastic film or suitable paper material having a silicon release layer 18 on one surface thereof completes the laminate by being secured to the adhesive layer 14. Typically, the liner 16 is 25–75 lb. kraft paper, and most preferably 50 lb. kraft. As is well known in the art, the release layer 18 allows for removal of the liner 16 from the adhesive layer 14 in standard fashion.

Figure 2:
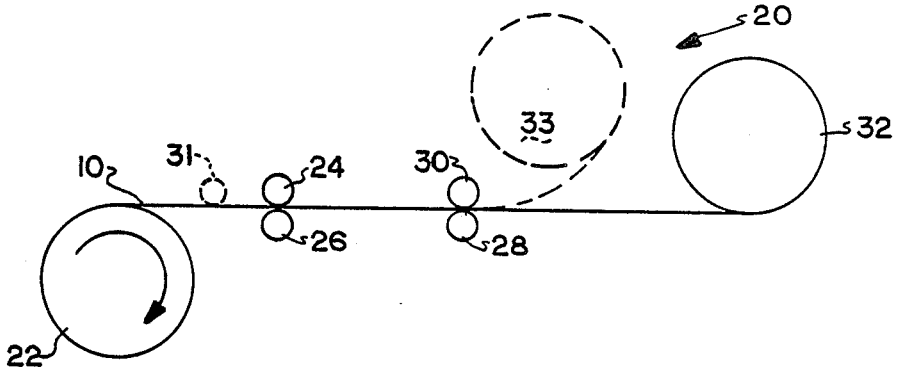
FIG. 2 is an illustrative view of the die cutting assembly for forming the seals of the invention from the laminate of FIG. 1.

With reference now to FIG. 2, a die cutting system for developing tamper evident bottle seals from the adhesive laminate 10 may be seen as designated generally by the numeral 20. A master feed roll 22 of the laminate 10 is maintained upon a spindle or other appropriate means to allow free rotation thereof. The web of laminate 10 is drawn from the roll 22 through a top cutting die 24 which operates in standard fashion in spaced relationship to a steel anvil back-up roll 26. The top cutting die 24 is operative to cut the face sheet 12 in a specific configuration as will be discussed in detail with respect to FIG. 3. Passing from the die and roll 24, 26, the web of laminate 10 then passes to the undercutting die 28 which is maintained in fixed spaced relationship from a steel anvil backup roll 30. The under cutting die 28, as will be discussed hereinafter with respect to FIG. 4, is operative for imparting a patterned cut to the liner 16. The laminate 10, cut on both the face sheet 12 and liner 16 may then be taken up by the take-up roll 32 for implementation by a converter or bottler for use as tamper evident bottle seals.

Those skilled in the art will readily appreciate that the specific order of processing steps for achieving the seal of the invention may vary. With continued reference to FIG. 2, it will be seen that a printing roll 31, shown in phantom, may be interposed in the line prior to the top cutting die 24, 26 for printing the label areas of the face sheet 12 immediately prior to the cutting of the labels by the die assembly 24, 26. Similarly, the matrix or waste portion of the face sheet 12 which remains after the cutting of the labels may be removed from the liner 16 by the take-up roll 33, shown in phantom, prior to the take-up roll 32. In the embodiment just discussed, the take-up roll 32 maintains a roll of liner 16 carrying an array of printed labels which may then be used by a bottler. Of course, the order of printing, if desired, as well as matrix removal may vary as desired by the end user.

Figure 3:
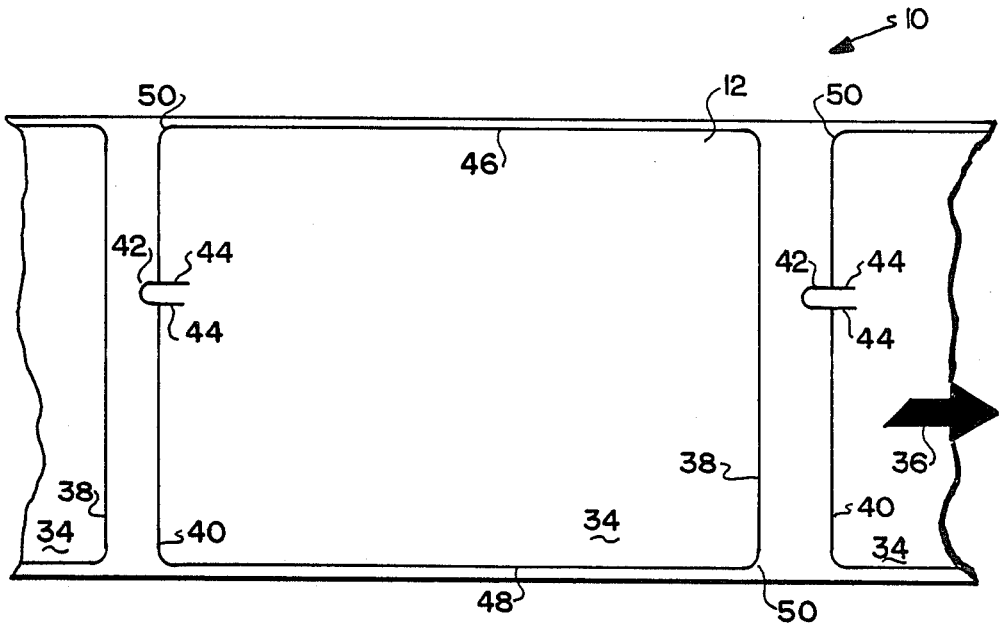
FIG. 3 is a partial view of a web of the laminate 10 after being processed by the top cutting die.
Figure 4:
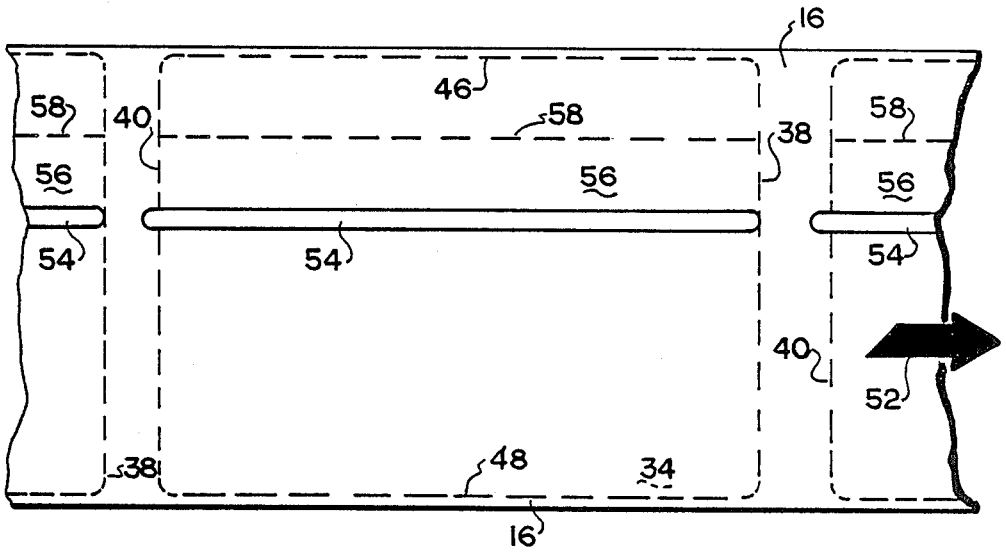
FIG. 4 is a partial sectional view of the web of laminate 10 after being processed by the bottom cutting die.

Referring now to FIG. 3, the web of the laminate 10 may be seen from the top showing the face sheet 12 having been cut by the top cutting die 24. As shown, the die 24 is operative to die cut label seals 34 into the face sheet 12 as the web 10 moves in the direction of the arrow 36. The die cutting edges of the tool 24 are operative for imparting a leading edge cut 38 and trailing edge cut 40 spaced apart a distance just slightly greater than the circumference of the bottle upon which the seal is to be used. Preferably, the spacing between the edges 38, 40 is on the order of 1/16–¼ inch, and preferably ⅛ inch. The edges 38, 40 are straight, and are normal to the direction of travel of the web of laminate 10.

Also cut into the face sheet 12 by the cutting die 24 is a tab 42 which extends perpendicularly from the edge 40 into the body of the label seal 34 as along the lateral side cuts 44. The degree of extension is preferably between ⅛–½ inch and preferably 3/16 inch. As will be noted hereinafter, the width of the tab 42 may vary, depending, in part, upon where the tab will lie upon the bottle with respect to the joinder of the cap and bottle.

Also die cut into the face sheet 12 are top and bottom edges 46, 48 which are typically parallel to the direction of travel of the web 36 and perpendicular to the leading and trailing edges 38, 40. Such die cutting is again achieved by the die cutter 24 which similarly provides for the rounded corners 50 at the junction between the longitudinal cuts 46, 48 and lateral cuts 38, 40. As will be well appreciated by those skilled in the art, the die cutting of the face sheet 12, while performed upon the entire laminate 10, leaves the liner 16 uncut. The cuts shown in FIG. 3 are only through the face sheet 12, the spacing between the top cutting die 24 and steel anvil back-up roll 26 being such as to accommodate the thickness of the liner 16 and to leave it in tack at this stage of the operation.

FIG. 4 shows the bottom side of the laminate 10, being the liner 16, after it passes through the cutting operation performed between the die and roll 28, 30. Here, the arrow 52 shows the direction of travel of the web of the laminate 10 which has, at this point in time, already had the face sheet 12 cut in the fashion described above. The undercutting die 28 cuts the liner 16 to define tear strips 54 which are of the same width as the tab 42 and in registration therewith and extending along the entire width of the seal 34. The remainder of the liner 16 remains totally in tack along the entire web. The spacing between the end of one tear strip 54 and the beginning of the next is ⅛–½ inch and, most preferably, 3/16 inch such that the backing 16 will remain in tack when the labels 34 are removed from the backing 16 with the tear strips 54 attached thereto. Again, it will be understood by those skilled in the art that the die cutter 28 is spaced from the back-up roll 30 a distance sufficient to accommodate the thickness of the face sheet 12, allowing the die to make complete penetration through the liner 16.

As shown in FIG. 2, the laminate cut as shown in FIGS. 3 and 4 is then stored on the take-up roll 32 for delivering to the ultimate user. There, the label seals 34 are removed from the liner 16 for placement upon a bottle to secure the same in the manner to be discussed hereinafter. It will be understood that when a label seal 34 is removed from the liner 16, the tear strip 54 remains laminated to the label seal to serve the purpose of separating or tearing the seal 34 into upper and lower portions to allow removal of the cap of a bottle in a manner to be discussed hereinafter.

Figure 5:
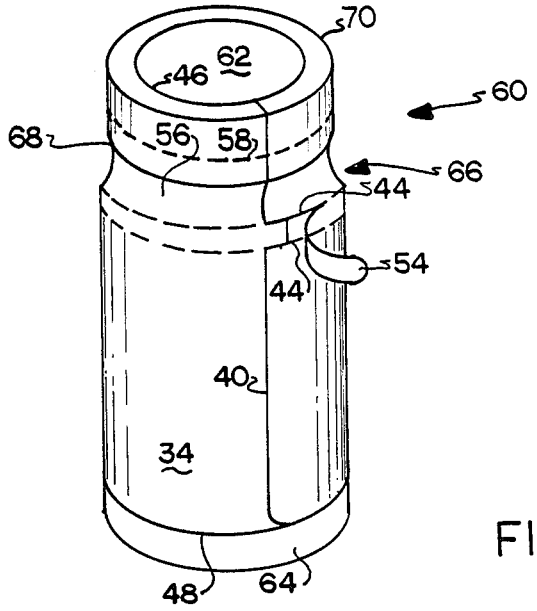
FIG. 5 is a perspective view of a necked bottle employing the seal of the invention.

FIG. 5 shows the application of a label seal 34 to a bottle and cap assembly 60. In standard fashion, a cap 62 is secured to an open end of a bottle 64 after the latter has been filled with a desired item. The bottle 64 has a neck 66, of smaller diameter than the body of the bottle 64, adapted to receive the cap 62. The cap and bottle join along a line 68 as shown. The seal 34, removed from the liner 16, is then wrapped about the bottle and cap assembly 60, with the edge 46 extending above the top of the bottle a distance of approximately ⅛–¾ inch and preferably ¼ inch. The pressure sensitive adhesive 14 allows for secured engagement of the heat shrink face sheet 12 to the assembly 60 with an overlap of 1/16–½ inch and preferably ¼ inch. As discussed above, the tear strip 54 of the material of the liner 16 remains attached to the underside of the label 34 and in registration with the tab 42.

With the label seal 34 adhesively secured to the bottle and cap assembly 60, heat is applied to effect a heat shrink of the label seal 34 to the assembly 60, causing the seal 34 to conform to the contour of the bottle 60 and forming the flange or lip 70 over the cap 62 thereof. Accordingly, the cap 62 cannot be removed from the bottle 64 without some destructive action on the label seal 34. To achieve this technique, it is preferred that the face sheet 12 be of an oriented heat shrink material, shrinking only in the direction in alignment with the axis of the bottle as shown in FIG. 5. It is also preferred that the edge 46 extend over the top of the cap to form the flange 70, but it will be understood that a seal may be attained without such flange and with the edge 46 lying somewhere about the periphery of the cap 62.

Access to the bottle 64 can only be made by removal of the cap 62 which, in turn, can only be achieved by breaking of the seal 34. The tear strip 54 encircles the bottle 64 and is adhesively attached to the seal 34 the entire distance. Further, the tear strip 54 is adhesively secured to the pull tab 42 and is aligned between the lateral side cuts 44. These side cuts 44 serve to initiate the tear of the seal 34 when the tab 42 and adhering strip 54 are pulled about the bottle circumference. The tear strip 54 defines the tear path while adding strength and integrity to the thin face sheet 12 at the tear line. It should be appreciated that the tear strip 54 may be implement in sealing arrangements other than for a tamper evident assembly. The formation of a tear strip 54 from the liner 16 is, in itself, a unique approach to devices for opening sealed packages and the like.

It should now be apparent that the tab 42 and tear strip 54 allow for a separation of the seal 34 into upper and lower portions such that the cap 62 may be removed from the bottle 64. To assure this, once the strip 54 is removed there should be no further interconnection by means of the seal 34 between the cap 62 and bottle 64. Such may be achieved in different ways. As shown in FIGS. 4 and 5, just prior to the application of the label seal 34 to the bottle assembly 60, the adhesive 14 in a zone 56 lying between the tear strip 54 and line 58 may be deadened or inactivated. Such operation is well known to those skilled in the art, as by chemical or other application. In any event, the adhesive effect within the zone 56 is negated and the zone 56 is geometrically so configured as to bridge the junction 68 between the cap 62 and bottle 64. Further, the zone extends completely to the tear strip 54 such that upon removal of the tear strip 54 the seal 34 consists of an upper portion which is adhesively adhered only to the cap 62 and a lower portion which is adhesively adhered only to the bottle 64. Accordingly, the cap 62 may then be readily removed.

For a necked bottle, it is also contemplated that the tear strip 54 may be positioned at the last point of contact with the bottle and that the label then bridge the shoulder and neck portion of the bottle such that the next adhesive contact is with the cap itself. A void thus exists between the label and the bottle assembly in this area. Removal of the tear strip 54 thus separate the label into two portions, one adhered to the bottle and the other adhered only to the cap.

Figure 6:
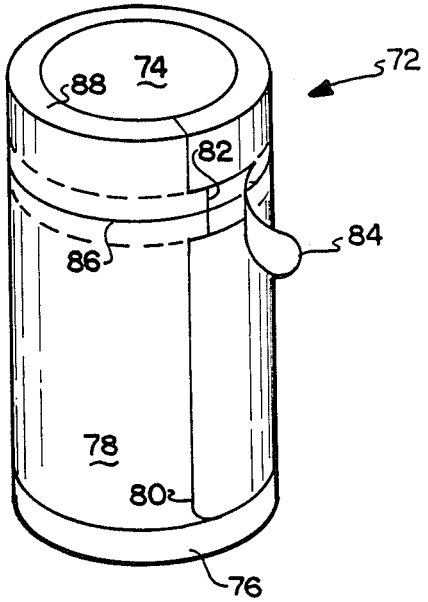
FIG. 6 is a perspective view of an unnecked bottle employing the seal of the invention.

The processes just described of deadening the adhesive in a particular area or bridging the neck are effective for necked bottles such as that shown in FIG. 5. However, for bottles which are of consistent diameter and wihtout a significant neck, the tear strip may be sufficiently wide to bridge the junction between the cap and bottle so that the adhesive need not be deadened, eliminating a step in the manufacture and application of the seal. As shown in FIG. 6, a bottle and cap assembly 72 includes a cap 74 affixed to a bottle 76 of uniform diameter. The die-cut seal label 78 is adhered to the bottle as before and then heat shrunk. The edges 80, 82 overlap as before, but in this case the tear strip 84 is sufficiently wide as to bridge the junction 86 between the cap and the bottle. Typically, the tear strip 84, comprising a face sheet 12 with liner 16 attached, would be of a width of ⅛–1 inch, sufficient to allow for standard manufacturing tolerances while assuring that the tear strip 84 will be in registration with the junction 86. Again, and in standard fashion, a flange 88 is formed over the cap 74 during the heat shrinking operation. It will be readily appreciated that when the tear strip 84 is removed, separating the label seal 78 into upper and lower portions, the upper portion is adhered solely to the cap 74, while the lower portion is adhered solely to the bottle 76, assuring that the cap 74 may be easily removed.

The benefits of the foregoing should be readily apparent to those skilled in the art. The label seal of the invention can serve the dual function of being both a safety or tamper evident seal, while also serving as a label if imprinted. The seal may be of unitary construction while covering both the bottle and cap. By being of a heat shrink material, the seal may be shrunk to conform to the contours of the bottle while defining a flange over the cap so that the cap may not be removed without evident damage to the label seal itself. The lable seals may be made using presently existing die-cutting techniques in the art by forming either a matrix of such seals from a moving web of laminate or a single lineal order as preferred by the ultimate user.

Thus it can be seen that the objects of the invention have been achieved by the structures and techniques presented hereinabove. While in accordance with the patent statutes only the best mode and preferred embodiments of the invention have been presented and described in detail, it is to be understood that the invention is not limited thereto or thereby. Accordingly, for an appreciation of the true scope and breadth of the invention reference should be had to the following claims.

What is claimed is:

1. A laminate, comprising:

a face sheet having adhesive on a first surface thereof;

a backing sheet having a release coating on a first surface thereof, said adhesive on said first surface of said face sheet being received by said release coating on said first surface of said backing sheet;

wherein said face sheet has a geometric configuration cut therethrough, said face sheet further having a tab cut therethrough, said tab traversing an edge of said geometric configuration; and wherein said backing sheet is characterized by a tear strip cut therethrough, said tear strip being in registration with said tab and traversing said geometric configuration.

2. The laminate according to claim 1 wherein said face sheet comprises a heat shrink sheet.

3. The laminate according to claim 2 wherein said face sheet is polyvinyl chloride, having a thickness of 0.0005–0.0035 inch.

4. The laminate according to claim 3 wherein said backing sheet comprises a kraft paper.

5. The laminate according to claim 1 wherein said geometric configuration is rectangular.

6. The laminate according to claim 1 wherein said first surface of said face sheet is devoid of adhesive in a zone coextensive with said tab and said tear strip.

7. The laminate according to claim 1 wherein said adhesive is a pressure sensitive adhesive.

8. The laminate according to claim 1 wherein said face and backing sheets comprise a web.

9. The laminate according to claim 8 wherein said web is characterized by a plurality of said geometric configurations cut through said face sheet, said geometric configurations being in spaced apart aligned relation to each other.

* * * * *